United States Patent [19]

Schwickrath

[11] Patent Number: 4,836,624

[45] Date of Patent: Jun. 6, 1989

[54] ANTI-TIP DEVICE

[75] Inventor: Bruce R. Schwickrath, Thornton, Colo.

[73] Assignee: Intellistor, Inc., Longmont, Colo.

[21] Appl. No.: 177,658

[22] Filed: Apr. 5, 1988

[51] Int. Cl.[4] ..... E05G 65/46

[52] U.S. Cl. ..... 312/216; 211/4

[58] Field of Search ..... 312/216, 107.5, 274, 312/275; 211/4

[56] References Cited

U.S. PATENT DOCUMENTS

| | | | |
|---|---|---|---|
| 1,238,228 | 8/1917 | Weil | 312/317 R |
| 1,695,896 | 12/1928 | Holden | 312/216 |
| 3,002,797 | 10/1961 | Stark | 312/317 R |
| 3,058,320 | 10/1982 | Foster et al. | 312/311 X |
| 3,135,570 | 6/1964 | Erismann | 312/311 |
| 3,738,727 | 6/1973 | Race et al. | 312/276 |
| 3,893,740 | 7/1975 | England | 312/216 |
| 3,912,350 | 10/1975 | Gurubatham | 312/276 |
| 4,067,444 | 1/1978 | Wilson | 312/216 X |
| 4,372,632 | 2/1983 | Villa et al. | 312/216 X |
| 4,632,446 | 12/1986 | Douglass | 312/216 X |

*Primary Examiner*—Joseph Falk

*Attorney, Agent, or Firm*—Dorr, Carson, Sloan & Peterson

[57] ABSTRACT

An anti-tip device for a free-standing cabinet that has within it one or more forward sliding compartments, such as shelves, drawers or bins, is comprised of a pair of horizontal arms which are attached to the front of the cabinet, and which pivot on a vertical axis between a retracted position flush with the cabinet face and an extended position perpendicular to the cabinet face in response to the forward movement of a cabinet compartment.

7 Claims, 2 Drawing Sheets

200
224
210
226
222
111
100
100

200
224
340
100b
210
230
226
100
460
570
100
460
215
220
300
300
350
100a
222

ANTI-TIP DEVICE

BACKGROUND OF THE INVENTION

1. Field of the Invention

This invention relates to an anti-tip mechanism for a free standing cabinet, and more particularly to an anti-tip mechanism for an open-front cabinet containing electronic components, with a forward sliding compartment.

2. Discussion of Prior Art

Cabinets in which items are held in forward-moving structures such as shelves, drawers or bins, efficiently combine storage and accessibility. Such forward-moving structures enable the cabinet contents to be used without being removed from the cabinet by merely sliding the structure forward to gain access to its contents. However, this forward movement shifts the center of gravity of the cabinet and makes the cabinet prone to falling forward. Devices which extend in front of free-standing cabinets and stabilize the cabinet when these structures are in their forward position prevent tilting of the cabinet.

Such anti-tip devices are commonly incorporated into the design of home appliances, such as dishwashers. In the case of a dishwasher, the forward-moving dish rack rests directly on the appliance's horizontally-hinged, front access door. Two general solutions have been posed to counteract the appliance's tendency to tip forward in response to a downward force applied to the door or because of the weight of dishes in the appliance rack.

One approach has been to directly support the door of the appliance. U.S. Pat. No. 3,912,350 issued to Gurubatham discloses a panel, normally coplanar with the appliance door, which moves linearly forward to a supporting position under the fully-opened door. This panel moves on a spring-loaded cable system attached to the door and rear panel. The cable system is mounted on the interior of the appliance cabinet. A pulley and lever connection causes the panel to move forward in response to the opening of the door, and to retract upon closing the door. The use of this particular anti-tip device is dependent on the availability of space within the cabinet to house the cable system, and is appropriate only to support a single, horizontally protruding structure.

Disclosed in U.S. Pat. No. 3,738,727 issued to Race et al. is another approach specifically designed for appliances with horizontally hinged front access doors. An arm which moves in a forward and downward direction in response to the opening of the appliance access door braces the cabinet against forward tilting. Operation of the arm is afforded by a series of springs and levers within the cabinet. In its tip-preventing position, this arm forms a hypotenuse across the right angle created by the front of the appliance and the floor.

Although these mechanisms suffice to support a single forward-moving structure, that is, the horizontally hinged appliance door for which they were designed, they do not accommodate multiple forward-moving structures. The complexity of these mechanisms not only precludes multiple installations in the same cabinet, but also contributes to difficulty in installation and maintenance.

A stationary anti-tip structure is illustrated by the "OPTIMUM Modular Packaging System" made by the Gichner Systems Group. This structure is an extension of the cabinet floor several inches beyond the front of the cabinet. This permanent structure is visually unappealing and, more importantly, obstructs floor space in front of the cabinet and access to the cabinet interior. The extension in front of the cabinet creates a shelf-like structure which cannot be used for storage because to do so would obstruct the opening of the cabinet door. Furthermore, this shelf-like structure collects dust which is drawn into the cabinet by air currents created when the door is opened. Whereas access to the cabinet contents is only sometimes essential, most of the time the passageway in front of the cabinet is in use. Obstruction of floor space by anti-tip means which are necessary only infrequently is a very inefficient use of costly and valuable space.

SUMMARY OF THE INVENTION

The object of the present invention is to provide an anti-tip device for a free standing cabinet that has within it one or more forward-sliding compartments. These compartments may be shelves, drawers, bins or other forward-moving components. By bracing the front of the cabinet, this invention offsets the imbalance of the cabinet created by forward movement of an inner compartment and prevents the cabinet from tipping forward.

The anti-tip device of the present invention is made of metal to provide strength and durability. The arms may be constructed as 4-sided hollow shafts or, for economy, may be 3-sided. The simplicity of design lends itself to either welded or bolted fabrication. The device may be an integral part of cabinet construction or may be retrofitted to any existing cabinet. Finishing of the device may match or accent the finish of the cabinet.

The smooth and simple operation of the anti-tip device of the present invention makes it easy to use and very effective in providing stable, balanced support for a free-standing cabinet. In its simplest configuration, this anti-tip device is comprised of a pair of horizontal arms which are attached to and which pivot on a vertical axis around the lower front portion of the cabinet sidewalls. These arms, in a retracted position, fold flush against the front face of the cabinet. In this folded position the arms are unobtrusive and conveniently out of the way of traffic moving past the front of the cabinet. The fact that the arms hide the hardware by which they are attached to the cabinet makes the device an aesthetically pleasing component of a storage system. Also, the flush mounting of the device on the cabinet face causes no reduction of floor space in front of the cabinet and no loss of internal capacity of the cabinet.

Tilt prevention is afforded in the extended position of these arms. This extended position is a forward extending position perpendicular to the stored position flush with the cabinet face. Movement between the two positions is allowed by pivoting means at the juncture of the arm and the cabinet.

Effective pivoting means can be of any one of many different types. For example, a pin mechanism or hinges may be used. There is some advantage to detachable fixation of the arms to the cabinet in that removal of the anti-tip device may permit easier modification or maintenance of the free standing cabinet.

On the underside of the arms at the end distal to the cabinet, are placed adjustable support means. These adjustable support means provide support for the anti-tip arms with a light touch against the floor so as not to inhibit the gentle swing of the device between extended and retracted positions. Ideally, these support means are comprised of a metal disk to which is fitted a threaded shaft that is received by a threaded hole in the anti-tip arm. This embodiment allows the arm to be leveled appropriately for any surface.

Also at the distal ends of the arms on the rear face may be placed a holding means to hold the arms in the retracted position against the face of the cabinet. Such holding means may be any one of several different types. A magnetic disk which is thin and firmly affixed to the arm is herein described as the preferred embodiment. Hooks, friction closures, or latches, as well as many other different holding means, could be used.

The length of the anti-tip arms that is necessary to prevent tipping of the free standing cabinet is a function of the degree of forward extension characteristic of the cabinet's compartments and the weight supported by the cabinet compartment in that forward position. In most cases, sufficient security against tipping is afforded by two arms each of which are as long as one-half the width of the cabinet on which they are mounted or can be longer if they are designed to collapse or interlock.

In the preferred embodiment, the anti-tip arms are the horizontal arms of two L-shaped members. The vertical leg of these L-shaped members is mounted on the front edge of the cabinet side support so that the L-shaped member pivots on an axis parallel to the front edge of the side support. This embodiment provides two significant advantages. First of all, this vertical leg allows attachment of the anti-tip device to the cabinet at a location in addition to the juncture of the arm and the cabinet at the base of the edge of the front side support. This double attachment creates a more stable configuration which is desirable in most situations and essential in many. Secondly, these vertical legs can be constructed so as to inherently provide an opening mechanism for the device. This is accomplished by fabricating the vertical leg so that in its retracted position the width of the leg is slightly greater than the width of the edge of the front cabinet side supports. The vertical leg thereby overlaps the front opening of the cabinet and abuts the front edge of the forward-sliding cabinet compartment. In this conformation, forward extension of the cabinet compartment automatically extends the anti-tip arms when the front edge of the compartment moves into and past the overlapping part of the vertical leg.

The length of the vertical leg may be determined by the factors of a given installation. For example, where the free standing cabinet has fixed shelves covered by a door at the top of the cabinet and a forward moving bin in the bottom, the vertical legs need extend only up to the door of the cabinet.

Attachment of the vertical legs to the cabinet may be accomplished, as in the case of horizontal arms, in many different ways, and the advantages of detachability of the vertical legs are applicable in the same way as in the case of horizontal arms. Both installation of the anti-tip device and maintenance of the cabinet is made easier by detachable fixation of the device to the cabinet. This also aids in shipping.

In the preferred embodiment here illustrated, vertical legs which extend for the entire height of a cabinet are illustrated as being removably attached to a cabinet expressly made for installation of the anti-tip device. In this embodiment, a bracket securely attached to the bottom of the cabinet floor at the front corners supports in a hole a pin which is affixed to the proximal end of the horizontal arm on the lower narrow side of the arm. To encourage free movement of this pivoting means a friction reducing washer such as a nylon brush is installed between the bottom of the horizontal arm and the bracket.

At the top of the vertical leg a spring-loaded bolt provides a releasable pivoting means. These are conventionally available such as from H. A. Guden Company, Inc., 1375 Banger Street, Copiague, L.I., N.Y. 11726 as Model DOUBLE DUTY LATCH HINGE #9294LH02 or 9294RH02. This bolt is accessible to the user through the rear face of the vertical leg. It is mounted through two cylindrical guides affixed to the inside of the vertical leg and oriented so that the bolt moves in a vertical direction. Between the two cylindrical guides a spring surrounds the bolts. A stopping means which is a narrowing of the bolt near the bottom of the upper cylindrical guide prevents movement of the spring toward the upper end of the bolt. A handle at the lower end of the bolt permits the bolt to be moved in a downward direction thus compressing the spring against the lower cylindrical guide and retracting the top of the bolt toward the end of the vertical leg. The bolt is aligned with and, when the tension on the spring is released, received by a hole in a portion of the cabinet ceiling which overhangs the vertical legs.

This configuration of pivoting means enables the anti-tip device to be easily removed by merely drawing down the bolt handle to release the upper attachment and lifting the L-shaped member out of the lower bracket.

Accordingly, the present invention provides a simple and effective means to prevent forward tipping of a free standing cabinet in response to the imbalance created by extension of a forward-moving inner compartment.

DESCRIPTION OF THE DRAWING

The present invention will be discussed in detail with reference to the accompanying drawing in which.

DESCRIPTION OF THE INVENTION

Figures 1, 2:
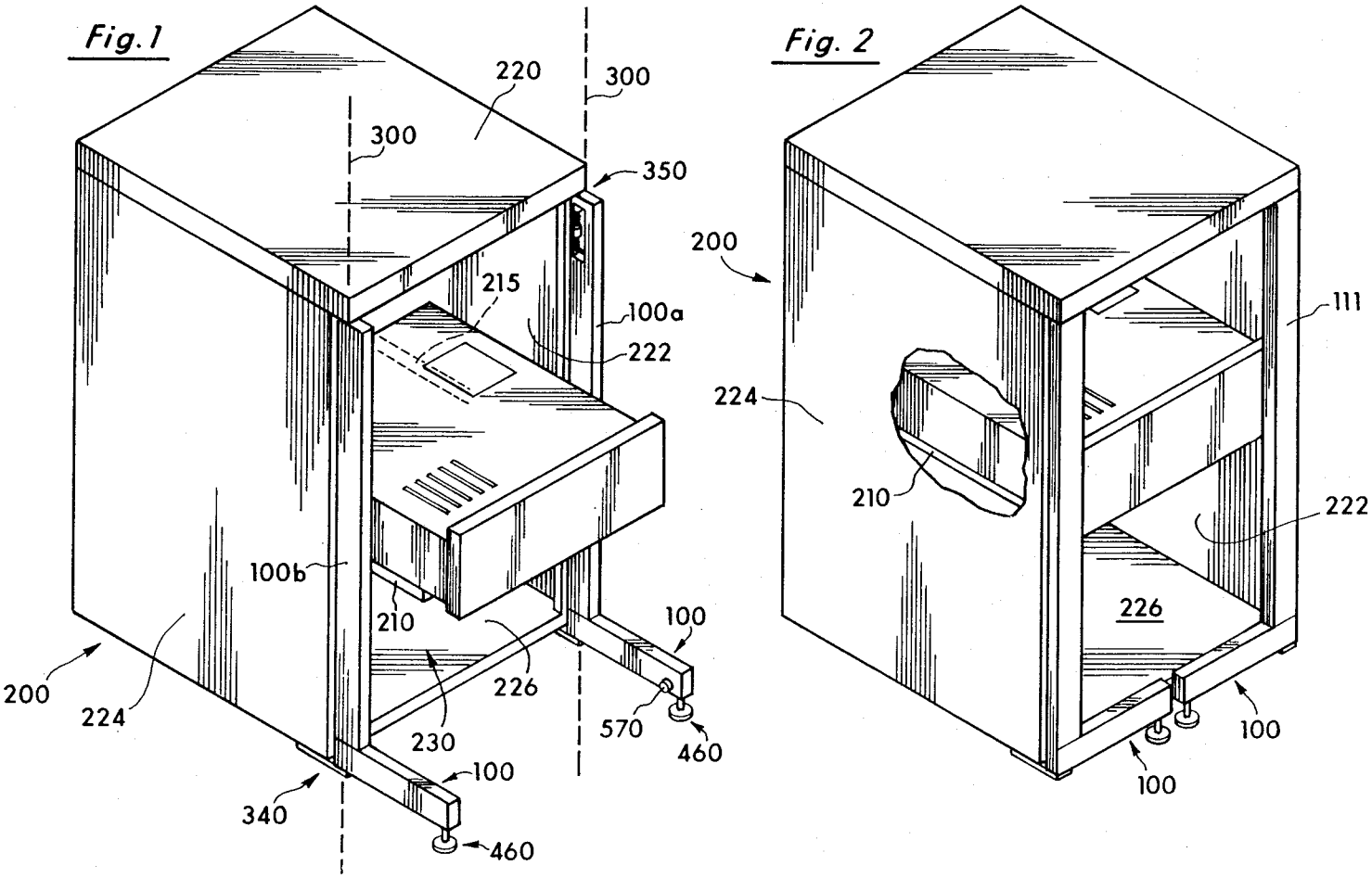
FIG. 1 is a perspective view of the use of the anti-tip device in conjunction with a free standing cabinet containing a forward-sliding shelf.
FIG. 2 shows the anti-tip device in its retracted position with the sliding shelf fully within the free standing cabinet.

The general concept of the operation of this invention is illustrated in FIGS. 1 and 2. The anti-tip device 100 is a pair of L-shaped members **100*a* and 100*b* which are mounted along an axis 300 parallel to the front edges of the side supports 224 and 222 of a free standing cabinet 200 which has a sliding shelf 210. Pivotal rotation of the L-shaped members 100*a* and 100*b* is afforded by detachable pivoting means 340 and releasable pivoting means 350. Detachable pivoting means 340, which are described in greater detail in conjunction with FIG. 4, support the L-shaped members 100***a* and 100*b* at the floor 226 of the free standing cabinet 200. The releasable pivoting means 350, which are further described in the discussion of FIG. 5, support the L-shaped members 100*a* and 100*b* at the ceiling 220 of the free standing cabinet 200. In its extended position, as illustrated in FIG. 1, the anti-tip device 100 prevents the cabinet 200 from falling forward in response to the imbalance created by the forward movement of the sliding shelf 210 through the cabinet's open face 230 along conveying means 215 mounted on the cabinet's side supports 224 and 222. Adjustable support means 460 provide support for the L-shaped members 100*a* and 100*b* in their extended position.

Magnetic holding means 570 hold the L-shaped members 100*a* and 100*b* in the retracted position illustrated in FIG. 2. When the sliding shelf 210 is fully within the cabinet 200 the anti-tip device 100 folds neatly against the front edges of the cabinet side supports 224 and 222 and floor 226. The anti-tip device 100 has a closed front face 111 in this retracted position and the mounting hardware, including the detachable pivoting means 340, the releasable pivoting means 350, and the magnetic holding means 570 illustrated in FIG. 1, are concealed.

The simplicity and effectiveness of the concept of the present invention can be achieved by configurations other than that illustrated as the preferred embodiment of FIGS. 1 and 2. The L-shaped members 100*a* and 100*b*, for example, could be shorter in either the horizontal or vertical direction. In some cases the vertical leg 120 of FIG. 3 may be omitted entirely. Shortened horizontal or vertical dimensions might be appropriate where extension of the L-shaped members 100*a* and 100*b* is inhibited by circumstances of installation or where only minimal support is necessary because the load on the sliding shelf 210 is light. L-shaped members 100*a* and 100*b* shorter in the vertical dimension might be appropriate where the cabinet's open face 230 was only partial. Such might be the case when the forward sliding compartment of the cabinet 200 was not an upper shelf 210 as here illustrated, but was instead a lower drawer or bin.

Figure 3:
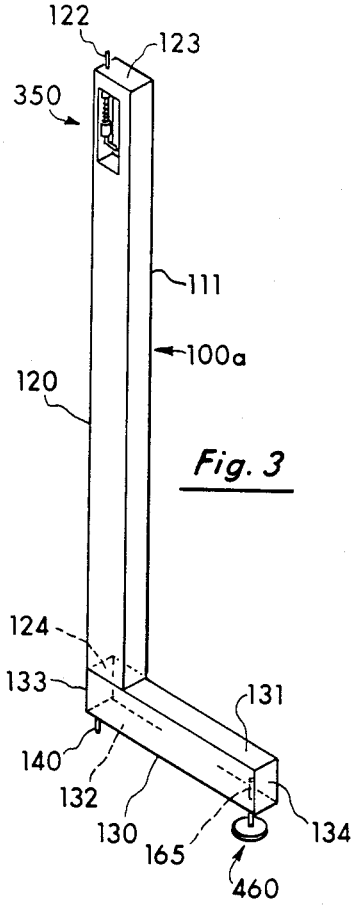
FIG. 3 shows one of two mirror-image L-shaped members and cut-away views of the releasable pivoting means and the adjustable support members.

FIG. 3 illustrates in detail one of two mirror image L-shaped members 100*a* and 100*b* which comprise the anti-tip device 100. As shown, the L-shaped member 100*a* is comprised of a vertical leg 120 and a horizontal arm 130. The vertical leg 120 and horizontal arm 130 are essentially rectangular hollow shafts with closed ends. Each has at least two narrow sides and a wider front side. The closed bottom end 124 of the vertical leg 120 abuts and is affixed to the upper narrow side 131 of the horizontal arm 130 at the proximal closed end 133 of that horizontal arm 130. On the lower narrow side 132 of the horizontal arm 130 is located a pin 140, also near the proximal closed end 133. This pin 140 is a component of the detachable pivoting means more fully illustrated in FIG. 4. Near the distal closed end 134 of the horizontal arm 130 is located a threaded hole 165 on the lower narrow side 132. This threaded hole 165 accommodates the adjustable support means 460. At the top of the vertical leg 120 is a closed end 123 in which there is a hole 122. Through this hole protrudes the releasable pivoting means 350 which is more fully illustrated in FIG. 5. The front wider side of the vertical leg 120 and horizontal arm 130 forms the closed front face 111 of the L-shaped member 100*a*. The opposite rear face may be open or closed depending on whether the vertical and horizontal arms are 3-or 4-sided.

Figure 4:
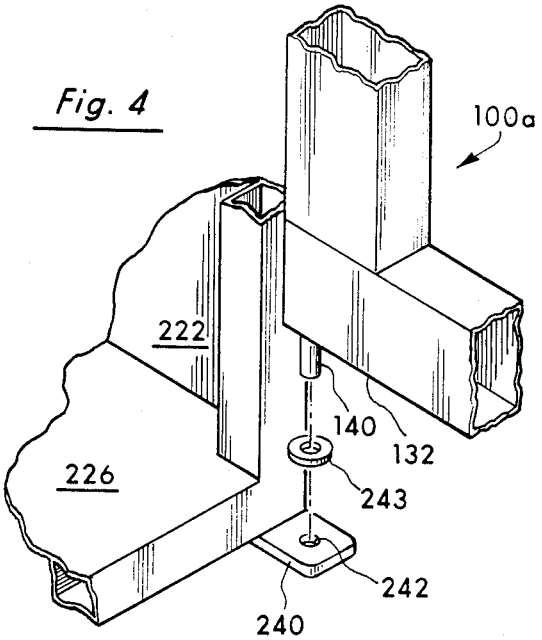
FIG. 4 is an enlarged view showing the detachable pivoting means ready for assembly.

The detachable pivoting means 340 is illustrated in FIG. 4 in a position ready for assembly. This illustration shows how the L-shaped member 100*a* is mounted on the cabinet at the front juncture of the cabinet side support 222 and cabinet floor 226. The pin 140 located in the horizontal arm's lower narrow side 132 fits through a friction-reducing washer 243 and into a hole 242 in a bracket 240 mounted on the front corner of the cabinet floor 226. To prevent loss of the washer 243 and promote ease of insertion of the L-shaped member 100*a* into the cabinet bracket 240, the friction-reducing washer 243 may be fixed to either the narrow lower side 132 of the horizontal arm or to the cabinet bracket 240 itself. The pin assembly here illustrated is the preferred embodiment of the detachable pivoting means 340. However, it should be noted that other pivoting means, such as a hinge assembly, could also be used. Reversal of the pin assembly, that is, placement of the pin 140 on the bracket 240 and placement of the hole 242 in the lower narrow side 132 of the horizontal arm 130, would create an equally effective pivoting means. The bracket 240 here illustrated is fabricated as an attachment to the cabinet 200. The bracket 240 could also be integrated into the initial construction of the cabinet as a part of the floor 226.

Figure 5:
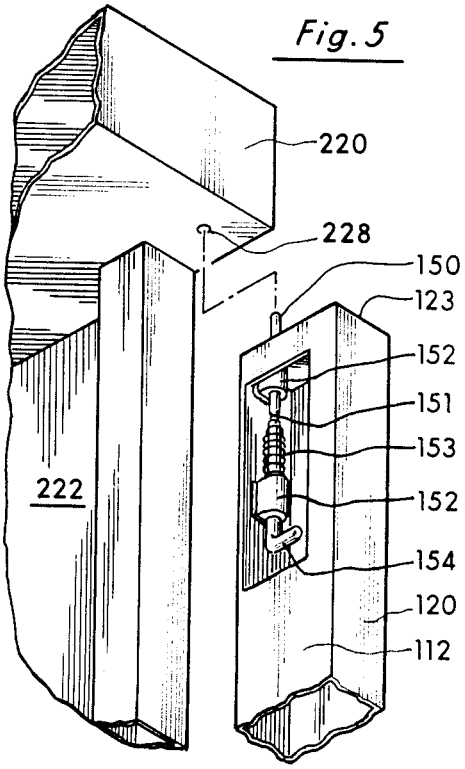
FIG. 5 illustrates an enlarged view of the releasable pivoting means in which the spring of the releasable pivoting means is in a partially compressed position.

FIG. 5 shows the detail of the releasable pivoting means of the preferred embodiment. A bolt 150 is mounted through a pair of cylindrical guides 152 which are in turn mounted on the inside of the rear narrow edge of the vertical leg 120. The bolt 150 moves vertically, extends through the top end 123 of the vertical leg 120, and is aligned with a hole 228 in the cabinet ceiling 220 near the front edge of the cabinet side support 222. The bolt 150 is encircled by a spring 153. Longitudinal motion of the spring 153 along the bolt 150 is prevented by the lower cylindrical guide 152 and a stopping means !51. The stopping means 151 is a narrowing of the bolt 150 which creates a depression in the bolt. The tension of the spring 153 causes the spring 153 to be held in place in this depression. Access to the releasable pivoting means is gained through the rear face 112 of the vertical leg 120 and manipulation of the releasable pivoting means is afforded by a handle 154 at the end of the bolt 150. Drawing the handle 154 in a downward motion causes compression of the spring 153 between the lower cylindrical guide 152 and the stopping means 151. Relaxation of the spring 153 causes the bolt to move upward and engage the hole 228 in the cabinet ceiling 220. This simple and effective pivoting means is preferred, however numerous other pivoting means, for instance hinge, rachet, hook, or latch means, could also be used. Attachment of the releasable pivoting means to the side support or to a bracket affixed to the cabinet especially for this purpose, is envisioned as being potentially more appropriate in some installations.

Figure 6:
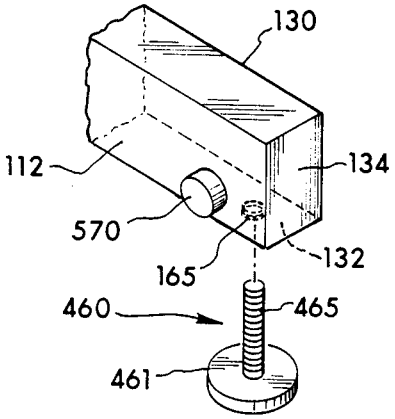
FIG. 6 provides an enlarged and cut-away view of an L-shaped member and its associated adjustable support means and magnetic holding means.

The enlarged cut-away view of the horizontal arm 130 shown in FIG. 6 illustrates the adjustable support means 460 and the magnetic holding means 570. The adjustable support member shown is comprised of a disk 461 to which is attached a threaded shaft 465. A threaded hole 165 near the distal end 134 of the lower narrow edge 132 of the horizontal arm 130 receives the threaded shaft 465 of the adjustable support member 460. Proper adjustment of this support member by varying the distance between the disk 461 and the lower narrow edge 132 of the horizontal arm 130 provides stability of the horizontal arm 130 in its extended position on virtually any surface. A fixed support member could be used on a flat level surface. Other types of support members, such as a peg or wheel, could also be used in some cases. The magnetic holding means 570 is a thin, flat magnetic piece affixed to the rear face 112 of the horizontal arm 130. This magnetic holding means 570 engages the front edge of the cabinet floor 226 when the horizontal arm 130 is in a retracted position. Many devices other than that illustrated would suffice to hold the horizontal member in a retracted position.

While preferred embodiments of the present invention have been shown, it is to be expressly understood that modifications and changes may be made thereto and that the present invention is set forth in the following claims.

I claim:

1. An anti-tip device for a free-standing, cabinet, said cabinet having side supports, a floor, and an open front, said cabinet further containing a sliding shelf mounted on conveying means affixed to the interior of said side supports so that said sliding shelf moves horizontally through said open front along said conveying means, said anti-tip device comprising:

a pair of upright, L-shaped members, each of said L-shaped members having a vertical leg and a horizontal arm, said vertical leg and horizontal arms being substantially rectangular hollow shafts having at least two narrow sides and one wider side, said vertical leg being substantially as long as the height of said cabinet and said horizontal arm being half as long as the width of said cabinet, said vertical leg terminating in a closed top end having a formed hole and a closed bottom end and said horizontal arm having upper and lower narrow sides, said closed bottom end of said vertical leg abutting and affixed to a longitudinal end of said narrow upper side of said horizontal arm, said horizontal arm terminating in a proximal closed end near the attachment of said vertical leg to said horizontal arm and a distal closed end opposite from said proximal closed end, said distal end of said horizontal arm further having a threaded hole in said lower narrow side, said wider side of said vertical leg and said wider side of said horizontal arm being oriented in a vertical plane forming a closed front face of said L-shaped member when said L-shaped members are in a retracted position in which said L-shaped members are adjacent to the front edges of said side supports and said floor of said cabinet, said L-shaped members having a rear face opposite said closed front face;

a pair of detachable pivoting means, each of said detachable pivoting means comprising a pin affixed to said lower narrow side of said proximal end of said horizontal arm, and said pair of detachable pivoting means further comprising a substantially rectangular, thin, horizontal bracket affixed to opposite front corners of the underside of said cabinet, each of said brackets extending in a forward direction for a distance approximately equal to the width of said narrow side of said horizontal arm, each of said brackets having a formed lower hole for receiving said pin, said pair of pivoting means further comprising a thin, friction-reducing washer, each of said washers having a diameter substantially equal to said width of said narrow side of said horizontal arm, said pins having a length slightly greater than the thickness of the combination of said bracket and said washer so that, when said pins are downwardly inserted respectively through said washer and into said lower hole in said brackets, removable attachment of said L-shaped members to said cabinet at the junctions of said proximal ends of said horizontal arms of said L-shaped members with said lower front corners of said cabinet is permitted and rotation of said L-shaped members on axes parallel to the front edges of said side supports is allowed;

a pair of releasable pivoting means accessible through said rear face of said L-shaped members, each of said releasable pivoting means having a bolt mounted through a pair of cylindrical guides, said guides affixed in alignment on the inner surface of said hollow shaft of said vertical legs so that said bolt moves through said guides in a vertical direction, said bolt extending through said formed hole in said closed top end of said vertical leg, said cabinet having opposite front upper corners each having an upper hole in vertical alignment with said lower hole in said brackets, said upper hole having a size appropriate to receive the upper end of said bolt, said bolt encircled by a spring between said guides, said bolt having a stopping means, said stopping means being able to hold the upper end of said spring so that compression of said spring is caused by downward motion of said bolt and relaxation of said spring coincides with upward motion of said bolt, said bolt further having a handle means, said handle means being located at the lower end of said bolt so compression of said bolt may be easily accomplished;

a pair of adjustable support members, each of said adjustable support members having a smooth disk of a diameter greater than said width of said narrow side of said horizontal arm, said adjustable support members further each having a centrally attached threaded shaft for adjustable attachment of said support members to said horizontal arms of said L-shaped members, so that said distal ends of said horizontal arms are firmly supported when in an extended position; and a pair of magnetic holding means, said magnetic holding means each attached near said distal ends of said horizontal arms so releasable contact is made between said L-shaped members and the front edge of said floor of said cabinet.

2. An anti-tip device for a free standing cabinet, said cabinet having side supports, and an open front, said cabinet further containing a horizontally sliding shelf, said anti-tip device comprising:

a pair of upright L-shaped members, each of said L-shaped members having a vertical leg and a horizontal arm, respectively removably and pivotally attached near opposite front portions of said side supports so that said L-shaped member pivot about a vertical axis between an extended and a retracted position by attachment means comprising:

(a) a pair of detachable pivoting means, each of said detachable pivoting means comprising a pin affixed to the lower side of said L-shaped member and a substantially rectangular, thin, horizontal bracket affixed to opposite front corners of the underside of said cabinet, each of said brackets extending in a forward direction, each of said brackets having a lower hole of receiving said pin, said pair of pivoting means further comprising a thin, friction-reducing washer, said pins having a length slightly greater than the thickness of the combination of said bracket and said washer so that, when said pins are downwardly inserted respectively through said washer and into said hole in said brackets, removable attachment of said L-shaped members to said cabinet is permitted and said detachable pivoting means allow said L-shaped members to freely swing on vertical axes parallel to the front edges of said side supports; and (b) a pair of releasable pivoting means, each of said releasable pivoting means having a bolt mounted through a pair of cylindrical guides, said guides affixed in alignment on said L-shaped members so that said bolt moves through said guides in a vertical direction, said bolt extending through the two of said L-shaped member, said cabinet having opposite front upper corners each having an upper hole in vertical alignment with said lower hole in said brackets, said upper hole having a size appropriate to receive the upper end of said bolt, said bolt encircled by a spring between said guides, said bolt having a stopping means, said stopping means being able to hold the upper end of said spring so that compression of said spring is caused by downward motion of said bolt and relaxation of said spring coincides with upward motion of said bolt, said bolt further having a handle means, said handle means being located at the lower end of said bolt so compression of said spring may be easily accomplished; and a pair of adjustable support members attached to said horizontal arms of said L-shaped members, so that said distal ends of said horizontal arms are firmly supported when in an extended position.

3. An anti-tip device for a free standing cabinet, said cabinet having side support, a floor, and an open front, said cabinet further containing a horizontally sliding shelf, said anti-tip device comprising:

a pair of upright L-shaped members, each of said L-shaped members having a vertical leg and a horizontal arm, respectively removably and pivotally attached near opposite front portions of said side supports thereby permitting rotation of said L-shaped members on vertical axes parallel to the front edges of said side supports;

a pair of adjustable support members attached to said horizontal arms of said L-shaped members, so that said distal ends of said horizontal arms are firmly supported when in an extended position; and a pair of releasable holding members retaining said L-shaped members in a retracted position flush with said open front and allowing said L-shaped members to pivot to said extended position upon release of said holding members, said holding members releasable by applying a pulling or pushing force to said L-shaped members, each of said holding members being attached near said distal ends of said horizontal arms.

4. An anti-tip device for a free standing cabinet, said cabinet having side supports, a floor, and an open front, said cabinet further containing a horizontally sliding shelf, said anti-tip device comprising:

a pair of upright L-shaped members, each of said L-shaped members having a vertical leg and a horizontal arm, respectively removably and pivotally attached near opposite front portions of said side supports thereby permitting rotation of said L-shaped members on vertical axes parallel to the front edges of said side supports, by attachment means comprising:

(a) a pair of detachable pivoting means, each of said detachable pivoting means comprising a pin affixed to the lower side of said L-shaped member and a substantially rectangular, thin, horizontal bracket affixed to opposite front corners of the underside of said cabinet, each of said brackets extending in a forward direction, each of said brackets having a lower hole for receiving said pin, said pair of pivoting means further comprising a thin, friction-reducing washer, said pins having a length slightly greater than the thickness of the combination of said bracket and said washer so that, when said pins are downwardly inserted respectively through said washer and into said hole in said brackets, removable attachment of said L-shaped members to said cabinet is permitted and said detachable pivoting means allow said L-shaped members to freely swing on vertical axes parallel to the front edges of said side supports; and (b) a pair of releasable pivoting means, each of said releasable pivoting means having a bolt mounted through a pair of cylindrical guides, said guides affixed in alignment on said L-shaped members so that said bolt moves through said guides in a vertical direction, said bolt extending through the top of said L-shaped member, said cabinet having opposite front upper corners each having an upper hole in vertical alignment with said lower hole in said brackets, said upper hole having a size appropriate to receive the upper end of said bolt, said bolt encircled by a spring between said guides, said bolt having a stopping means, said stopping means being able to hold the upper end of said spring so that compression of said spring is caused by downward motion of said bolt and relaxation of said spring coincides with upward motion of said bolt, said bolt further having a handle means, said handle means being located at the lower end of said bolt so compression of said spring may be easily accomplished; and a pair of adjustable support members attached to said horizontal arms of said L-shaped members, so that said distal ends of said horizontal arms are firmly supported when in an extended position; and a pair of releasable holding members retaining said L-shaped members in a retracted position flush with said open front and allowing said L-shaped members to pivot to said extended position upon release of said holding members, said holding members releasable by applying a pulling or pushing force to said L-shaped members, each of said holding members being attached near said distal ends of said horizontal arms.

5. The invention according to claim 3 or 4 wherein said adjustable support members are comprised of a smooth disk with a centrally attached threaded shaft for adjustable attachment of said disk to said L-shaped members, so that said L-shaped members are firmly supported when in an extended position.

6. The invention according to claim 3 or 4 wherein said releasable holding members are a pair of magnetic holding means, said magnetic holding means each attached to said L-shaped members so releasable contact is made between said L-shaped members and the front edge of said floor of said cabinet.

7. The invention of claim 1, or 3 wherein said L-shaped members in said retracted position partially occlude said open front so that extension of said anti-tip device occurs in response to forward movement of said sliding shelf.

* * * * *